US008511322B2

(12) United States Patent
Balestrini

(10) Patent No.: US 8,511,322 B2
(45) Date of Patent: Aug. 20, 2013

(54) POWDER COMPACT APPLICATOR

(75) Inventor: Thierry Balestrini, Leudeville (FR)

(73) Assignee: Alcan Packaging Beauty Services, Gennevillers (FR)

( * ) Notice: Subject to any disclaimer, the term of this patent is extended or adjusted under 35 U.S.C. 154(b) by 802 days.

(21) Appl. No.: 12/274,389

(22) Filed: Nov. 20, 2008

(65) Prior Publication Data

US 2009/0126759 A1 May 21, 2009

Related U.S. Application Data

(60) Provisional application No. 60/992,118, filed on Dec. 4, 2007.

(30) Foreign Application Priority Data

Nov. 21, 2007 (FR) ..... 07 08163

(51) Int. Cl.
*A45D 33/02* (2006.01)
*A45D 42/02* (2006.01)

(52) U.S. Cl.
USPC ..... 132/307; 132/305

(58) Field of Classification Search
USPC ..... 132/293, 298, 305, 306, 307; 206/823, 206/581
See application file for complete search history.

(56) References Cited

U.S. PATENT DOCUMENTS

| | | | | |
|---|---|---|---|---|
| 2,904,814 | A | 9/1959 | Scholl | |
| 5,865,194 | A | 2/1999 | Gueret | |
| 7,273,059 | B2 * | 9/2007 | Lee | 132/299 |
| 2004/0120753 | A1 | 6/2004 | Gieux et al. | |
| 2005/0141951 | A1 | 6/2005 | Gueret et al. | |
| 2006/0201528 | A1 * | 9/2006 | Lee | 132/299 |

FOREIGN PATENT DOCUMENTS

| | | |
|---|---|---|
| FR | 2829000 | 3/2003 |

* cited by examiner

*Primary Examiner* — Rachel Steitz
(74) *Attorney, Agent, or Firm* — Ladas & Parry, LLP

(57) ABSTRACT

A powder compact (10) comprising a case (20) forming a main make-up powder receptacle (21) and an applicator head (30) fitted to said case, said applicator head comprising a porous membrane (31) occupying the top part of said head and an auxiliary powder receptacle (32) used to retain part of said powder close to said porous membrane, said porous membrane being designed to come into contact with the skin to dispense said powder on said skin, wherein said powder compact comprises a cylindrical wall (35) which surrounds a communication channel (36) through which said auxiliary powder receptacle communicates with said main powder receptacle and at least one section of which is occupied by a sieve (40), the mesh of which is adapted to the particle characteristics of said powder in order to control its flow.

20 Claims, 3 Drawing Sheets

POWDER COMPACT APPLICATOR

This application claims the benefit of Provisional Application 60/992,118 filed Dec. 4, 2007.

TECHNICAL FIELD

The present invention refers to a powder dispenser for fine cosmetics.

BACKGROUND OF RELATED ART

From French patent application FR 2.829.000, a powder compact is known, comprising a case forming a main make-up powder receptacle, having a bottom and a side wall with an open end and a dispensing head comprising a connecting element fitted to the open end of said case side wall, a porous membrane occupying the top part of said head and designed to come into contact with the skin to distribute said powder on said skin, and an auxiliary powder receiving part used to retain a part of said powder close to said membrane. The powder, called up by tapping on the case, is projected from the bottom of the case towards the membrane, passing through a projecting element inserted in a hole worked into said auxiliary powder receiving part. Such a powder compact is therefore a compact unit which can be used directly by the user without needing to resort to a detachable accessory such as a powder puff. It is the powder compact itself which, by means of said porous membrane, acts as a powder puff. A difficulty related to this type of case lies in controlling the powder flow through the membrane.

From European patent application EP 1 428 453, a powder compact is known, comprising a case forming a main make-up powder receptacle, having a bottom and a side wall with an open end and a dispensing head fitted to the open end of said case side wall, a porous membrane occupying the top part of said head and a very porous synthetic foam pad placed between the receptacle and the membrane used to store a part of said powder close to said membrane.

While the membrane can be properly supplied by means of this open-pore pad, the fact remains that the rate of feed is difficult to control, depending on the particle-size distribution of the powder.

The purpose of the present invention is to provide a powder applicator similar to the above mentioned powder compacts but that can also be used for any type of product in powder form, in particular any cosmetic powder.

DESCRIPTION OF THE INVENTION

A first subject according to the invention is a powder compact comprising a case forming a main make-up powder receptacle and an applicator head fitted to said case, said applicator head comprising a porous membrane occupying the top part of said head and an auxiliary powder receptacle used to retain part of said powder close to said porous membrane, said porous membrane being designed to come into contact with the skin to dispense said powder on said skin, wherein said powder compact comprises a cylindrical wall which surrounds a communication channel through which said auxiliary powder receptacle communicates with said main powder receptacle and at least one section of which is occupied by a sieve, the mesh of which is adapted to the particle characteristics, such as particle sizes, of said powder in order to control its flow.

Said porous membrane, designed to come into contact with the skin and to dispense powder over said skin, is typically a low-density alveolate synthetic sponge, with pores of average diameter ranging between 50 and 200 μm, preferably close to 100 μm. This membrane has an average thickness of a few millimeters, typically between 2 and 6 mm, preferably 3 to 4 mm. Its outer surface, designed to come into contact with the skin, can to advantage be flocked, so that it is covered with very fine plastic—typically a polyolefin or a polyamide—fibers, which give a velvet effect and make it softer to the touch.

The porous membrane preferably has a substantially axisymmetric shape with a diameter typically ranging between 20 mm and 100 mm, preferably between 40 and 60 mm. In order to make powder dispensing easier, the communication channel between the main receptacle of the case and the auxiliary receptacle of the head is placed so that it has the same axis of symmetry. Advantageously, the other parts of the powder compact are axisymmetric in relation to the same axis, in particular the case and the auxiliary powder receptacle, which makes it possible to store a small amount of powder near the porous membrane. The diameter of the communication channel is preferably quite high, typically equal to, or greater than, half the internal diameter of the case, to facilitate the transfer of powder towards the head.

Said powder compact comprises a cylindrical wall which surrounds a channel by which the auxiliary powder receptacle located in the head communicates with the internal volume of the case forming the main receptacle. This cylindrical wall may belong to the case or to the head, depending on how the head is fixed onto the case. The case typically has a bottom and a side wall. The latter may either have an open end, or be surmounted by a top wall provided with a neck. When the side wall is surmounted by a top wall provided with a neck, it is the neck which acts as the cylindrical wall allowing the main receptacle to communicate with the auxiliary receptacle.

But, preferably, the side wall has an open end onto which the head is fixed reversibly. Advantageously, the applicator head is provided with a fixing skirt that can be fitted inside and/or outside the open end of the side wall of the case. The fixing skirt of the applicator head and the side wall of the case are provided with complementary, and substantially reversible means of being unified. This embodiment is preferred because it allows the compact to be refilled with powder and/or a lid protecting the powder before it is used for the first time to be removed.

According to the invention, at least one sieve passes through the communication channel, the mesh of which is adapted to the particle characteristics of the powder in order to control its flow. Typically, the pattern of the sieve mesh corresponds to an opening whose shape factor (the ratio of the largest dimension to the smallest dimension in the plane of the mesh) is less than 2 and of which the largest dimension lies between 50 μm and 1500 μm, preferably between 80 μm and 800 μm, preferably still between 100 μm and 500 μm.

The sieve may be woven or unwoven. Preferably, a sieve made from a woven polyolefin, typically polyethylene or polypropylene, or from a polyamide, is chosen. Designed to filter all the powder to be applied, it can to advantage be treated so that it has the appropriate physical and chemical properties for the use to which it will be put, for example so as to have antibacterial properties.

The sieve can be fixed into the channel by gluing or by heat sealing. It can be glued or heat sealed directly into the bore of the communication channel, but is preferably fixed onto one end of said channel or is fixed onto a cylindrical component which is then inserted into the bore.

For still better control of the powder flow, the communication channel can be provided with n sieves, the number n typically ranging between 2 and 20, preferably between 2 and 5. Preferably, except for a special case of the second embodiment presented below, the closer the sieves are to the porous membrane, the smaller the dimensions of their meshes.

The powder compact is also provided with a lid designed to be placed so as to be removable above said porous membrane in order to isolate said porous membrane from the outside. The lid can be fixed either on the side wall of the case or on a side wall of the head.

According to a first embodiment, said sieve is placed on the end of the communication channel which is closest to the porous membrane. The space between said porous membrane and said sieve is part of the auxiliary powder receptacle. The head also comprises a ring-shaped support which surrounds the cylindrical wall bounding the communication channel. The ring-shaped support acts as a support for said porous membrane, at least around the periphery of said porous membrane. This ring-shaped support can also bound or be part of the auxiliary powder receptacle.

In a first alternative of this first embodiment, said ring-shaped support is a toric pad which supports the periphery of the membrane. For greater comfort when applying said membrane to the skin, said pad is made from a highly-flexible material, for example an elastomer, in particular one based on latex, such as SBR ("styrene butadiene rubber") or NBR ("acrylonitrile butadiene rubber"). In a second alternative, said ring-shaped support, made out of an elastomer, is funnel-shaped, with a cylindrical wall fitting around the cylindrical wall which bounds the communication channel and a tapered wall, which is adjacent to said cylindrical wall and which flares out towards the porous membrane so that its flared end acts as a support for the periphery of the porous membrane.

The porous membrane is provided with a ring-shaped edge whose end has a shrunken internal diameter, lower than the diameter of the flared end of the ring-shaped support, so that the latter projects radially and traps the shrunken ring-shaped edge of the membrane once the latter is fixed around the ring-shaped support. The tapered wall of the support also acts as an outer wall for the auxiliary powder receptacle.

In this first embodiment, whatever the alternative under consideration, a second sieve, or a perforated transverse wall, can be placed on the lower end of the communication channel.

According to a second embodiment, said communication channel has a large diameter, close to that of the porous membrane, typically ranging between 0.5 and 1 times the diameter of the porous membrane, so that it is not necessary to insert a peripheral ring-shaped support to support the periphery of said porous membrane. The end of the communication channel which is closest to said membrane can be provided with a perforated rounded shell which acts as support for said porous membrane. This perforated and rounded shell, concave towards the receptacle, here mainly acts as a flexible and elastic structural element, but it could also act as a sieve controlling the arrival of the powder onto the porous membrane. In such a layout, the volume of the auxiliary receptacle is very limited and it is then of advantage to provide the communication channel with another sieve, with a mesh that is preferably finer than that of the first sieve which acts as support for said porous membrane.

In this second embodiment, the porous membrane can advantageously be provided with a ring-shaped edge forming a rib towards the inside, and the end of the communication channel nearest to the porous membrane is provided with an outer rib so that the ring-shaped edge of the porous membrane can be clipped to the end of said cylindrical wall surrounding the communication channel.

Another subject deduced from the invention is a case, as above but modified in that said head does not include a porous membrane and in that the sieve, which preferably has a rounded shape, concave towards the receptacle, is fixed on the end of the communication channel facing outwards, the outer wall of the sieve being flocked so as to be soft to the touch, typically giving a velvet effect. This subject, of particular interest because of the small number of parts to be assembled, preferably has the geometry of the second embodiment, the communication channel typically having a diameter greater than half that of the case.

FIGURES

EXAMPLES

Example 1

Figure 1:
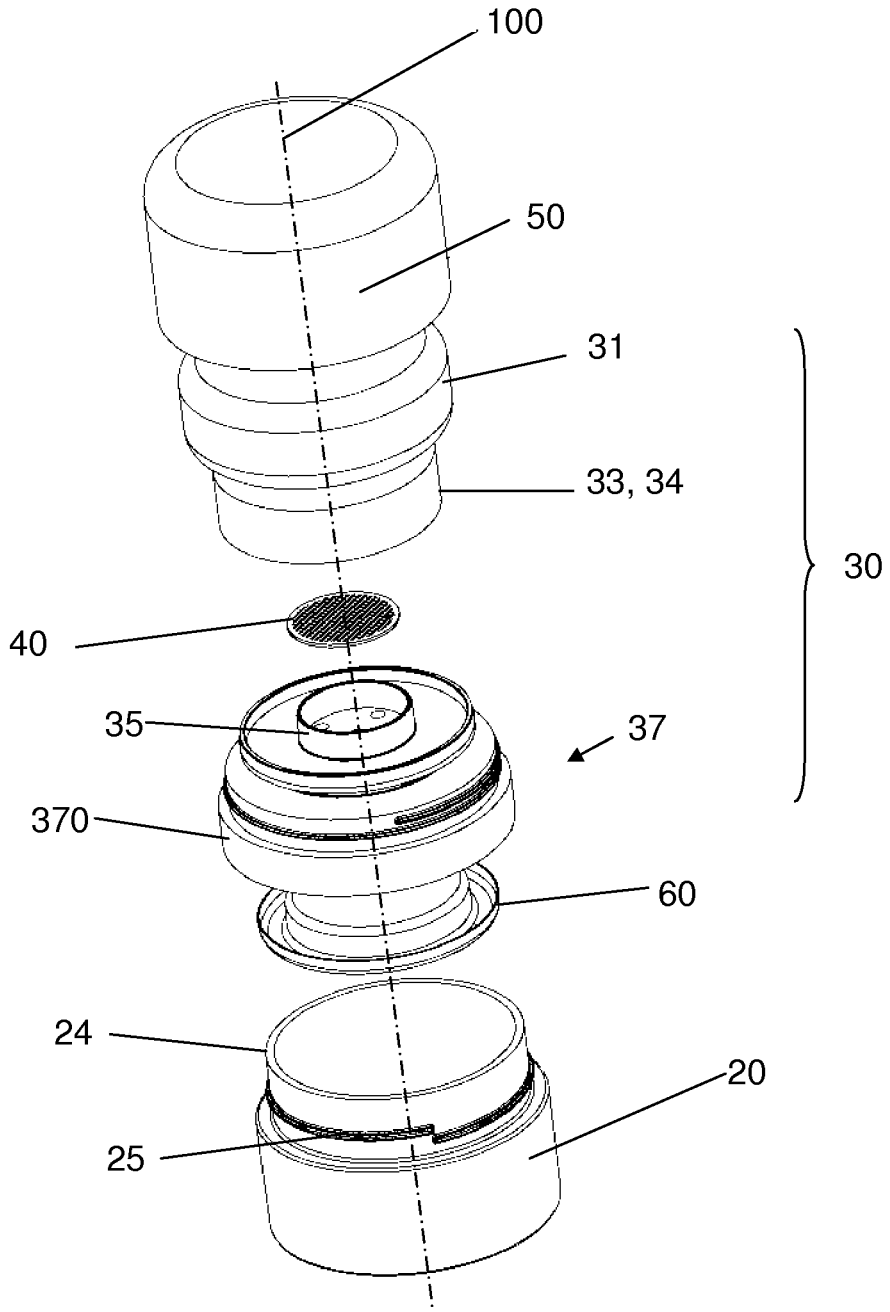
FIGS. 1 and 2 illustrate an exploded perspective and a diametrical section, respectively of a first embodiment of the invention for of an applicator case.
Figure 2:
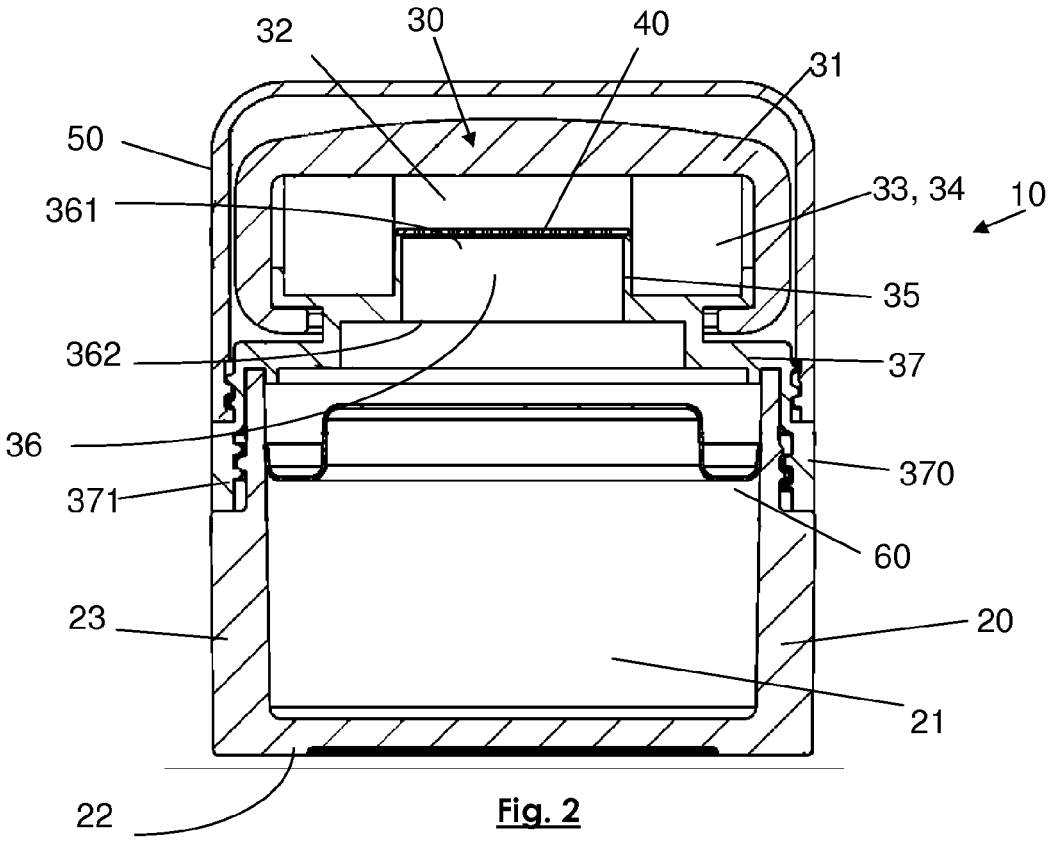
Figure 3:
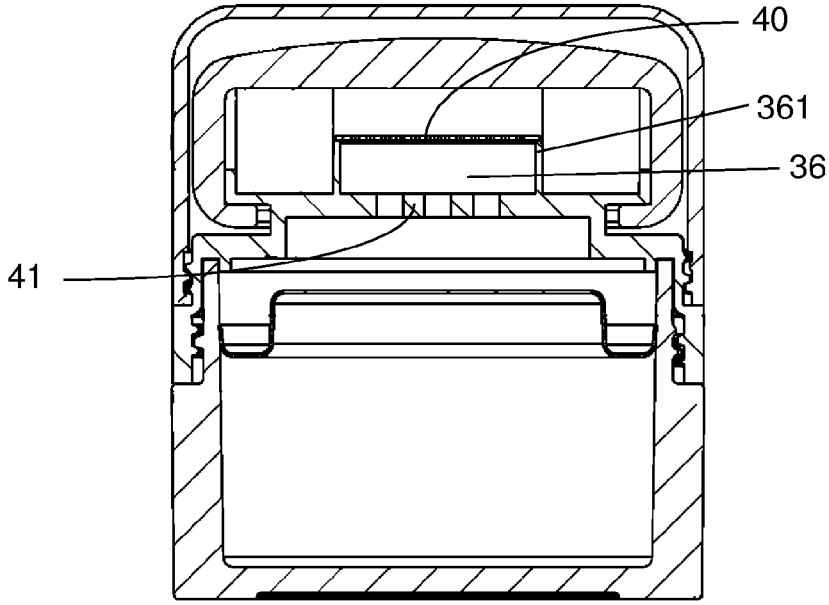
FIG. 3 illustrates a diametrical section of a second embodiment of the invention for an applicator case.
Figure 4:
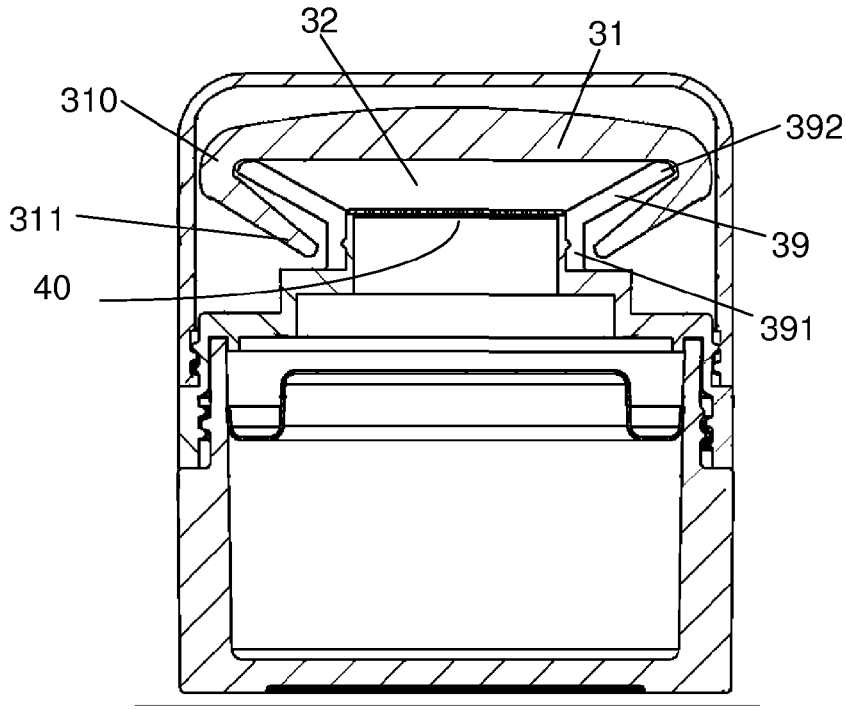
FIG. 4 illustrates a diametrical section of a third embodiment of the invention for an applicator case.
Figure 5:
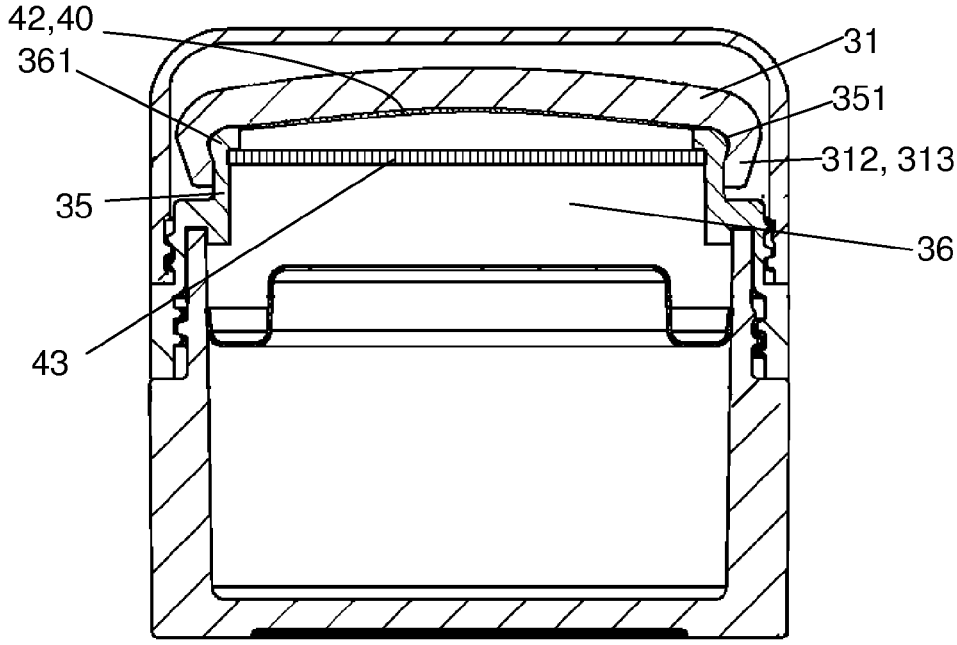
FIG. 5 illustrates a diametrical section of a fourth embodiment of the invention for an applicator case.

FIGS. 1 and 2

The first embodiment of the invention for a powder compact applicator 10 will be used to describe the invention in more detail. The powder compact applicator 10 comprises a case 20 forming the main receptacle 21 of make-up powder and an applicator head 30 fitted onto said case. The applicator head 30 comprises a porous membrane 31 occupying the top part of said head and an auxiliary powder receptacle 32 used to retain part of the powder close to the porous membrane 31.

The compact 10 comprises a cylindrical wall 35 which surrounds a communication channel 36 through which said auxiliary powder receptacle 32 communicates with said main powder receptacle 21. A sieve 40 crosses the communication channel 36. It is made from woven polyamide. In the specific case of the example, this sieve has a mesh of 250 μm. The mesh can be modified according to the type of powder to be applied.

The porous membrane 31 is a low density alveolate synthetic sponge, with pores of average diameter 0.1 mm. It has an average thickness of 4 millimeters. Its outer surface is flocked with very fine polyamide fibers.

All of the parts of the case have rotational symmetry around axis 100. The case, so that it can easily be held in the hand, has a side wall 23 whose external diameter is approximately 50 mm and whose internal diameter is close to 40 mm. The porous membrane 31 appears as a more or less flattened dome whose periphery has a diameter slightly greater than 45 mm. The communication channel 36 between the main receptacle 21 of case 20 and the auxiliary receptacle 32 of the applicator head 30 has a diameter of 20 mm, whereas the internal diameter of the case receptacle is 40 mm.

Case 20 has a bottom 22 and a side wall 23 with an open end 24.

The applicator head 30 comprises a connecting part 37 which includes the cylindrical wall 35 surrounding the communication channel 36. This connecting part 37 makes it possible to assemble the applicator head 30 onto case 20 reversibly. This connecting part 37 is provided with a fixing skirt 370 that can be fitted outside the open end 24 of the side wall 23 of case 20. The fixing skirt 370 of the applicator head 30 and the side wall 23 of case 20 are provided with complementary screw threads 25 and 370.

The sieve is here fixed at the top end 361 of the communication channel 36 by gluing its edge onto the mouth of the cylindrical wall 35.

The powder compact is also provided with a lid 50 designed to be placed so as to be removable above said porous membrane 31 in order to isolate said porous membrane from the outside. Lid 50 is here fixed onto the side wall of the connecting part 37 of the applicator head 30.

The space between the porous membrane 31 and sieve 40 forms the essential part of the auxiliary powder receptacle 32 in this example. Head 30 also comprises a ring-shaped pad 34 which is used as support for the periphery 310 of the porous membrane. This pad 34 has a bore which forms the side wall of the auxiliary receptacle 32. For greater comfort when applying said membrane to the skin, said pad is made from a highly-flexible material, for example a latex-based elastomer, such as SBR ("styrene butadiene rubber") or NBR ("acrylonitrile butadiene rubber").

Example 2

FIG. 3

The powder compact in this example is similar to the previous one: it differs from the former only by the addition of a perforated transverse wall 41 placed on the lower end of the communication channel 36.

The addition of this perforated wall, by the shape chosen and the layout of its perforations, contributes to better control of the powder flow. The perforated transverse wall can be replaced by a second sieve, preferably with a coarser mesh than that of the first sieve, assembled on the top end 361 of the communication channel 36.

Example 3

FIG. 4

The powder compact in this example is also similar to that of example 1. It differs by the choice of the ring-shaped support 33, which is here a part 39 in the shape of an upturned funnel, made from an elastomer, with a cylindrical wall 391 which fits around the cylindrical wall 35 bounding the communication channel 36 and a tapering wall 92, which is adjacent to the cylindrical wall 391 and which flares out towards the porous membrane 31 so that its widened end acts as a support for the periphery 310 of the porous membrane 31. The porous membrane 31 is provided with a ring-shaped edge 311 whose end has a shrunken internal diameter, lower than the diameter of the flared end of the ring-shaped support, so that the latter projects radially and traps the shrunken ring-shaped edge of the membrane once it has been fitted around the ring-shaped support. The tapered wall 392 of the support also acts as an outer wall for the auxiliary powder receptacle 32.

Example 4

FIG. 5

The case in this example has a communication channel 36 of large diameter, approximately 40 mm, close to that of the porous membrane 31, which is approximately 45 mm.

End 361 of the communication channel 36 which is closest to the porous membrane 31 is connected to a rounded sieve 42, which is used not only to control the powder flow but also acts as support for the porous membrane 31. This sieve is rounded, with its concavity directed towards the receptacle, and acts as a flexible and elastic structural element. In such a layout, the volume of the auxiliary receptacle is very limited and it is then of advantage to provide the communication channel 36 with a second sieve 43.

The porous membrane 31 can advantageously be provided with a ring-shaped edge 312 forming a rib 313 towards the inside, and the end 361 of the communication channel nearest to the porous membrane 31 is provided with an outer rib 351 so that the ring-shaped edge 312 of the porous membrane 31 can be clipped to the end of said cylindrical wall 35.

LIST OF REFERENCES

10 Powder compact applicator
20 Case
21 Main powder receptacle
22 Case bottom
23 Case side wall
24 Open end of the case side wall
25 Means of unifying the case with the applicator head (here, a screw thread)
30 Applicator head
31 Porous membrane
310 Periphery (or peripheral part) of the porous membrane 31
311 Ring-shaped edge of the porous membrane 31
312 Edge of the porous membrane 31
313 Rib
32 Auxiliary powder receptacle
33 Ring-shaped support
34 Pad
35 Cylindrical wall
351 Outer peripheral rib
36 Communication channel
361 End of communication channel 36 nearest to the porous membrane 31
362 End of communication channel 36 nearest to the receptacle 21
37 Connecting piece
370 Fixing skirt
371 Means of unifying the applicator head with the case (here, a screw thread)
39 Funnel-shaped part
391 Cylindrical part of part 39
392 Tapered part of part 39
40 Sieve
41 Perforated transversal wall
42 Perforated rounded shell
43 Second sieve
50 Lid
60 Cover
100 Axis of symmetry

The invention claimed is:

1. A powder compact comprising a case forming a main make-up powder receptacle and an applicator head fitted to said case, said applicator head comprising a porous membrane occupying the top part of said head and an auxiliary powder receptacle used to retain part of said powder close to said porous membrane, said porous membrane being designed to come into contact with the skin to dispense said powder on said skin, wherein said powder compact comprises a cylindrical wall which surrounds a communication channel through which said auxiliary powder receptacle communicates with said main powder receptacle and at least one section of which is occupied by a sieve disposed between the main powder receptacle and said auxiliary powder receptacle, said sieve having a mesh adapted to the particle characteristics of said powder in order to control its flow.

2. A powder compact according to claim 1, wherein said porous membrane has a substantially axisymmetric shape around an axis and said communication channel between said case and said head has said axis of symmetry as its axis.

3. A powder compact according to claim 1, wherein the case and the auxiliary powder receptacle are also axisymmetric around said axis.

4. A powder compact according to claim 3, wherein the diameter of said communication channel is greater than half of the internal diameter of the case.

5. A powder compact according to claim 1, wherein the case has a bottom and a side wall with an open end on which the applicator head is fixed reversibly, said applicator head being provided with a fixing skirt that can be fitted inside and/or outside the open end of the side wall of said case, the fixing skirt of the applicator head and the side wall of the case being provided with complementary and substantially reversible means of being unified.

6. A powder compact according to claim 1, wherein the pattern of the sieve mesh corresponds to an opening whose shape factor is lower than 2 and of which the largest dimension is between 50 μm and 1500 μm.

7. A powder compact according to claim 1, wherein said sieve is made from a woven polyolefin.

8. A powder compact according to claim 1, wherein said sieve is treated so as to have physical and chemical properties suitable for using said powder.

9. A powder compact according to claim 1, wherein the communication channel is provided with a plurality of n sieves, with number n ranging between 2 and 20.

10. A powder compact according to claim 9, wherein the closer the sieves are to the porous membrane, the more the dimensions of their meshes decrease.

11. A powder compact according to claim 1 also provided with a lid designed to be placed so as to be removable above said porous membrane in order to isolate said porous membrane from the outside.

12. A powder compact according to claim 1, wherein said sieve is placed on the end of said communication channel which is closest to the porous membrane.

13. A powder compact according to claim 12, wherein a second sieve, or a perforated transverse wall, is placed on the other end of said communication channel.

14. A powder compact according to claim 1, wherein the applicator head also comprises a ring-shaped support which surrounds the cylindrical wall which bounds the communication channel, the ring-shaped support being used as support for said porous membrane, at least in the peripheral part of said porous membrane.

15. A powder compact according to claim 14, wherein said ring-shaped support is a pad made of highly-flexible synthetic foam, of type "NBR soft or SBR soft".

16. A powder compact according to claim 14, wherein said ring-shaped support, is a funnel-shaped part, made from an elastomer with a cylindrical part fitting around the cylindrical wall which bounds the communication channel and a tapered part, which is adjacent to said cylindrical wall and which flares out towards the porous membrane so that its flared end acts as support for the periphery of the porous membrane.

17. A powder compact according to claim 1, wherein said communication channel has a diameter close to that of the porous membrane, the end of the communication channel which is closest to said membrane being provided with a perforated rounded shell, whose concavity is directed towards the receptacle and which is used as support for said porous membrane.

18. A powder compact according to claim 17, wherein said perforated rounded shell is said sieve, the mesh of which is adapted to the particle characteristics of said powder.

19. A powder compact according to claim 18, wherein said communication channel is provided with a second sieve, the mesh of which is preferably finer than that of the first sieve which is used as support for said porous membrane.

20. A powder compact according to claim 1, wherein the largest dimension is between 80 μm and 800 μm.

* * * * *